US012338717B2

(12) United States Patent
Lowe et al.

(10) Patent No.: US 12,338,717 B2
(45) Date of Patent: Jun. 24, 2025

(54) DOWNHOLE IGNITION ASSEMBLY

(71) Applicant: Schlumberger Technology Corporation, Sugar Land, TX (US)

(72) Inventors: Erick Lowe, Houston, TX (US); Hari Prakash Kalakonda, Pune (IN); Atsushi Nakano, Rosharon, TX (US); Bertha Wang, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/760,740

(22) Filed: Jul. 1, 2024

(65) Prior Publication Data

US 2025/0003317 A1 Jan. 2, 2025

Related U.S. Application Data

(63) Continuation of application No. 17/995,975, filed as application No. PCT/US2021/027452 on Apr. 15, 2021, now Pat. No. 12,024,986.

(60) Provisional application No. 63/011,046, filed on Apr. 16, 2020.

(51) Int. Cl.
*E21B 43/1185* (2006.01)
*F42D 1/05* (2006.01)

(52) U.S. Cl.
CPC ..... *E21B 43/1185* (2013.01); *F42D 1/05* (2013.01)

(58) Field of Classification Search
CPC .... E21B 43/1185; E21B 43/116; E21B 23/06; E21B 33/12; E21B 33/134; E21B 43/117; F42D 1/05; F42D 1/045
See application file for complete search history.

(56) References Cited

U.S. PATENT DOCUMENTS

| | | | | |
|---|---|---|---|---|
| 5,031,536 | A | 7/1991 | Barker | |
| 9,476,289 | B2 * | 10/2016 | Wells | E21B 33/13 |
| 9,598,942 | B2 * | 3/2017 | Wells | E21B 43/1185 |
| 9,752,421 | B2 * | 9/2017 | LaGrange | E21B 43/11852 |
| 11,808,093 | B2 * | 11/2023 | Eitschberger | E21B 17/028 |
| 12,024,986 | B2 * | 7/2024 | Lowe | F42D 1/05 |
| 2017/0009560 | A1 * | 1/2017 | Wells | E21B 33/134 |
| 2017/0211363 | A1 * | 7/2017 | Bradley | F42B 5/035 |

(Continued)

FOREIGN PATENT DOCUMENTS

| | | |
|---|---|---|
| CN | 110284855 | 9/2019 |
| WO | 9421882 A1 | 9/1994 |

OTHER PUBLICATIONS

International Search Report and Written Opinion issued in International Patent application PCT/US2021/027452 on Jul. 23, 2021, 8 pages.

(Continued)

*Primary Examiner* — Daniel P Stephenson
(74) *Attorney, Agent, or Firm* — Jeffrey D. Frantz

(57) ABSTRACT

A downhole ignition assembly is described herein. The downhole ignition assembly has a switch container having a longitudinal axis, the switch container having a first portion that accommodates a switch circuit in an orientation transverse to the longitudinal axis, and a second portion that contacts an igniter disposed in the second portion, the first portion having a contact that makes electrical contact with a tool coupled to the downhole ignition assembly.

20 Claims, 3 Drawing Sheets

(56) References Cited

U.S. PATENT DOCUMENTS

| | | | | |
|---|---|---|---|---|
| 2019/0162056 | A1* | 5/2019 | Sansing | F41A 19/65 |
| 2023/0184065 | A1* | 6/2023 | Lowe | F42D 1/05 102/202.12 |

OTHER PUBLICATIONS

International Preliminary Report on Patentability issued in International Patent application PCT/US2021/027452 dated Oct. 27, 2022, 7 pages.
Substantive Exam issued in Saudi Arabia Patent Application No. 522440950 dated Oct. 23, 2023, 13 pages.
Exam Report issued in UAE Patent Application No. P6002138/2022 dated Dec. 16, 2024, 9 pages.

* cited by examiner

DOWNHOLE IGNITION ASSEMBLY

CROSS REFERENCE PARAGRAPH

This application is a continuation of U.S. patent application Ser. No. 17/995,975, entitled "DOWNHOLE IGNITION ASSEMBLY," filed Oct. 11, 2022, now U.S. Pat. No. 12,024,986, which is a national stage entry under 35 U.S.C. 371 of International Application No. PCT/US2021/027452, entitled "DOWNHOLE IGNITION ASSEMBLY," filed Apr. 15, 2021, which claims the benefit of U.S. Provisional Application No. 63/011,046, entitled "DOWNHOLE IGNITION ASSEMBLY," filed Apr. 16, 2020, the disclosure of which is hereby incorporated herein by reference.

FIELD

Embodiments of the present invention generally relate to well perforation in oil and gas recovery. Specifically, embodiments of a downhole ignition assembly are described.

BACKGROUND

Hydraulic fracturing is a practice among geologic resource producers in which a geologic formation underground is subjected to a hydraulic shock to loosen tight formations and ease production of resources from the formation. Commonly, the resource is hydrocarbon liquids and/or gases.

A perforation tool, sometimes called a perforating gun, is used to prepare the formation for fracturing. The wall of the drilled well is perforated by activation of explosive charges. A jet of material creates an opening in the wall of the well that is a few inches to a few feet long, depending on the explosive discharge and the local structure and composition of the formation. Hydraulic fluid can then be provided to the opening and used to deliver the hydraulic shock.

Perforation is one example of a downhole tool that uses explosive charges. All such tools need ignition. An electrically activated ignition assembly is typically used to activate explosive tools downhole. A wireline delivers electrical energy to a combustible element, thus activating a ballistic discharge that, in turn, sets off the explosives in the tools. An ignition assembly is commonly used once, and then pulled out of the well and reassembled for another use. Speed and ease of reassembly is of paramount interest to avoid the need for numerous spare assemblies and time and effort to reassemble used assemblies. There is a need for improved downhole ignition assemblies that are reliable and easy to reassemble after use.

SUMMARY

Embodiments described herein provide a downhole ignition assembly, comprising a switch container having a longitudinal axis, the switch container having a first portion that accommodates a switch circuit in an orientation transverse to the longitudinal axis, and a second portion that contacts an igniter disposed in the second portion, the first portion having a contact that makes electrical contact with a tool coupled to the downhole ignition assembly.

Other embodiments described herein provide a downhole ignition assembly, comprising an ignition module coupled to a feedthrough module, the ignition module comprising an ignition housing with an igniter and a switch assembly disposed in the ignition housing, the switch assembly comprising a switch container housing a switch circuit, the switch container in electrical contact with the igniter and the feedthrough module; an igniter contact in electrical contact with the switch circuit and the igniter; and a feedthrough contact electrically connected between the switch circuit and a feedthrough member of the feedthrough module.

Other embodiments described herein provide an ignition module for a downhole ignition assembly, the ignition module comprising an ignition housing having a receptacle and a central passage extending from a floor of the receptacle; and a switch assembly disposed in the receptacle and extending along the central passage for energizing an igniter, the switch assembly having a ground path that bypasses the ignition housing.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
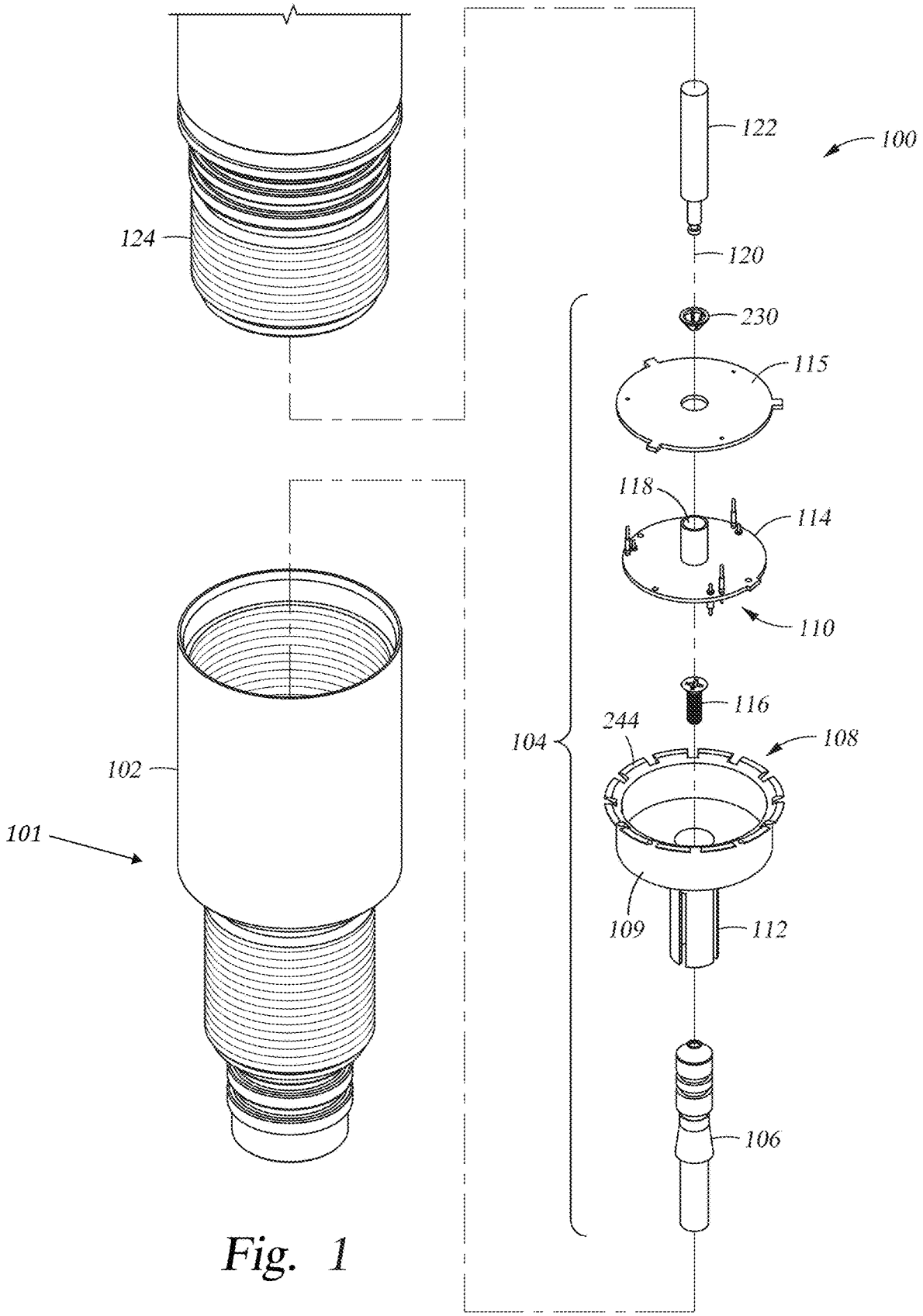
FIG. 1 is an exploded view of a downhole ignition assembly according to one embodiment.

FIG. 1 is an exploded side view of a downhole ignition assembly 100. The ignition assembly 100 is used to activate a downhole tool that uses explosive charges. The ignition assembly 100 generally comprises an ignition module 101 that engages with a feedthrough module 124. The feedthrough module 124 is any module that generally accomplishes electrical feedthrough to the ignition module 101, which may be a tool that utilizes ballistic ignition provided by the ignition module 101 or may be merely an electrical feedthrough module. The ignition module 101 features an ignition housing 102 that houses a switch assembly 104 and an igniter 106. The switch assembly 104 has a switch container 108 that has a first portion 109, which houses an electrical switch 110. The switch container 108 also has a second portion 112, which extends from the first portion 109, houses the igniter 106, and makes electrical contact with the igniter 106. The first portion 109 has a diameter larger than the second portion 112. The diameter of the second portion 112 is generally similar to the diameter of an igniter 106 to be housed in the second portion 112 to simplify making electrical contact between the second portion 112 and the igniter 106. The switch assembly 104 nests with the ignition housing 102. The downhole ignition assembly 100 is generally cylindrical in overall shape with a longitudinal axis 120, and each member of the assembly 100 has a generally cylindrical overall shape with a central, cylindrical, or longitudinal axis that coincides with the longitudinal axis 120 of the assembly when the members are assembled.

The switch 110 includes a circuit plate 114 that carries the electrical circuitry that makes up the switch. The circuit plate 114 generally rests within the first portion 109 in an orientation transverse to the longitudinal axis 120. An igniter contact 116 extends from a first side of the circuit plate 114 and a feedthrough contact 118 extends from a second side of the circuit plate 114 opposite from the first side. The feedthrough contact 118 generally connects the circuit plate 114 to a power source. In this case, the feedthrough contact 118 connects to a feedthrough member 122 of the feedthrough module 124 that carries electrical impulses and/or signals to other electrical switching and/or signaling apparatus. The feedthrough member 122 is surrounded by an insulator 123, and both are contained within a feedthrough housing 125, defining the main members of the feedthrough module 124. Here, the feedthrough module 124 is shown as a purely electrical feedthrough member separate from the ignition module 101, but the feedthrough module 124 can be part of a discharge tool, such as a perforating gun tool. The feedthrough module 124 nests with the switch assembly 104 and the ignition housing 102, and may nest with other tools.

An optional backing plate 115 may be included to enclose the circuit plate 114 in the first portion 109 of the switch container 108. The backing plate 115 in FIG. 1 has a central opening to fit around the feedthrough contact 118 so that the backing plate 115 can fit into the first portion 109 of the switch container 108. The backing plate 115 may have alignment features that help stabilize the orientation of the circuit plate 114 in the switch container 108. The backing plate 115 is optional in the sense that some embodiments do not use the backing plate 115 while other embodiments use the backing plate 115.

To assemble the downhole ignition assembly 100, the igniter contact 116 is coupled to the switch container 108, and the igniter 106 is attached to the igniter contact 116 to form a sub-assembly. In one embodiment, the igniter contact 116 is a threaded member and the igniter 106 is screwed onto the igniter contact 116. The sub-assembly is disposed in the switch container 108, and the feedthrough contact 118, and a feedthrough plug 230 (FIG. 2) are installed to form the switch assembly 104, which in turn is disposed in the ignition housing 102. The feedthrough member 122 is coupled to the feedthrough contact 118 to couple the switch assembly 104 to another tool. The ignition housing 102 can be fastened to the feedthrough module 124 by threaded connection with the feedthrough housing 125, or the ignition housing 102 can be fastened to a gun member or another member by threaded connection, or other connection that securely holds the switch assembly 104 in place.

Figure 2:
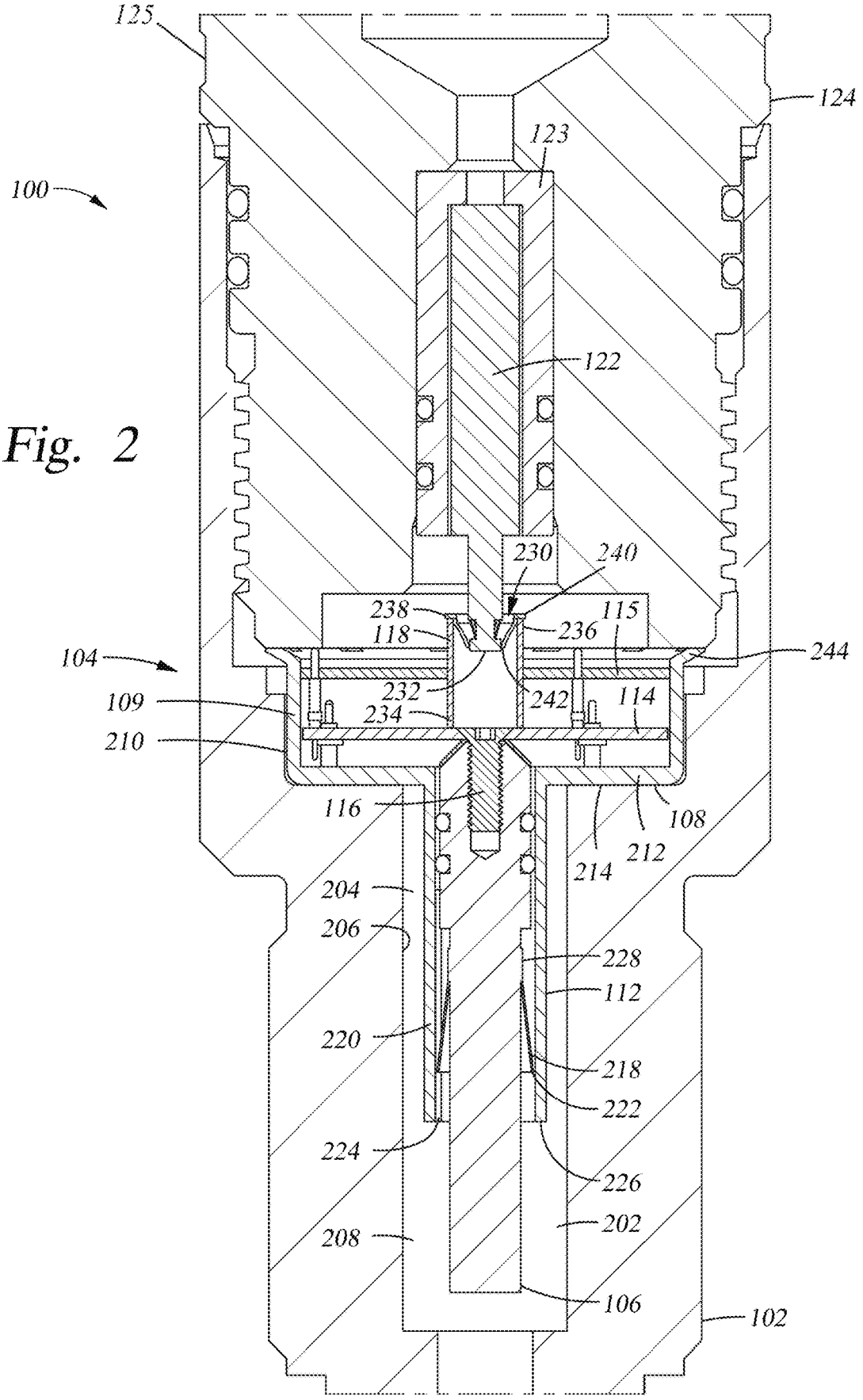
FIG. 2 is a cross-sectional view of the downhole ignition assembly of FIG. 1.

FIG. 2 is a cross-sectional view of the downhole ignition assembly 100 of FIG. 1 in assembled configuration. The ignition housing 102 has a central passage 202 that accommodates the igniter 106 and the second portion 112 of the switch container 108. The central passage 202 has an inner diameter that is larger than an outer diameter of the second portion 112, and larger than a diameter of the igniter 106. Thus, when the igniter 106 and switch assembly 104 are disposed in the ignition housing 102, a first annular gap 204, having a first width, is defined by an inner wall 206 of the central passage 202 and by an outer wall of the second portion 112, and a second annular gap 208, having a second width greater than the first width, is defined by the inner wall 206 and the igniter 106, with both the second portion 112 and the igniter 106 positioned coaxially with the central passage 202.

The first portion 109 has a diameter larger than a diameter of the second portion 112. The ignition housing 102 has a receptacle 210 that accommodates the first portion 109 of the switch container 108. The central passage 202 of the ignition housing 102 extends from a central area of the receptacle 210, so that the switch container 108 fits within the receptacle 210. Here, the receptacle 210 is fashioned with a diameter that matches an outer diameter of the first portion 109, such that the first portion 109 nests within the receptacle 210. A floor portion 212 of the first portion 109 generally contacts a floor portion 214 of the receptacle 210, while the second portion 112 of the switch container 108 extends into the central passage 202.

The igniter 106 is fashioned with a contact flange 218, which may be an integral part of the igniter 106 or a separate member. The contact flange 218 can also be a ridge that extends radially outward from a core of the igniter 106. In this case, the contact flange 218 has frustoconical shape with diameter that increases in a direction away from the igniter contact 116. A wide end 222 of the contact flange 218 is disposed against a lip 224 at an end 226 of the second portion 112 opposite from the first portion 109. A narrow end 228 of the contact flange 218, opposite from the wide end 226, contacts the core of the igniter 106. The lip 224 may be omitted, if desired, and the contact flange 218 can just contact the inner wall of the second portion 112 without the lip 224.

The feedthrough contact 118 is a generally cylindrical member. A first end 234 of the feedthrough contact 118 contacts the circuit plate 114. The feedthrough plug 230 is nested with a second end 236 of the feedthrough contact 118, opposite from the first end 234. The feedthrough plug 230 is a conductive member with a frustoconical shape that accommodates a contact end 232 of the feedthrough member 122. The feedthrough plug 230 has a first end 238 with a diameter greater than a largest diameter of the contact end 232 to accommodate accurate and easy connection of the contact end 232 with the feedthrough plug 230. The feedthrough plug 230 has a flange 240 at the first end 238 to maintain reliable contact with the second end 236 of the feedthrough contact 118. The diameter of the feedthrough plug 230 declines from first end 238 to a second end 242 of the feedthrough plug 230 to provide reliable electrical contact with the contact end 232 of the feedthrough member 122. The optional backing plate 115 is shown installed just inside the first portion 109 of the switch container 108. The backing plate 115 may be held in place by friction with the wall of the first portion 109.

The contact flange 218 contacts the igniter 106 and the switch container 108. In this case, the contact flange 218 and the switch container 108 are electrically conductive. The switch container 108 has a flange 244, at an edge of the first portion 109 thereof, which contacts the feedthrough housing 125 when assembled. Referring again to FIG. 1, the flange 244, in this case, has a circular tabbed format configured as a flared rim of the switch container 108 with periodic notches around the circumference thereof. The flange 244 can have any format that provides support for the switch assembly 104 and contact with the feedthrough housing 125, or any other compatible tool. For example, the flange 244 can be a smooth continuous rim, or the flange 244 can be configured as a few tabs, or even prongs, spaced around the rim of the switch container 108. Here, the tabs are shown squared-off at the ends, but the tabs could be rounded. In some cases, the flange 244 can be configured for enhanced electrical conductivity, for example by coating or plating with a higher-conductivity material. A small ring, thin wire, or even a few small dots of such higher-conductivity material, for example gold, can be plated around the perimeter of the flange 244 to enhance electrical conductivity thereof, if desired. It should be noted that where the flange 244 has notches, the backing plate 115 can include tabs that frictionally engage with the notches to hold the backing plate 115 in place, as shown in FIG. 1.

Referring again to FIG. 2, the ignition housing 102 also contacts the switch container 108, as described above, and the feedthrough housing 125. In this way, all the electrical components of the ignition assembly 100, including the ignition housing 102, the switch assembly 104, and the igniter 106, are grounded to the feedthrough module 124, in this case via the feedthrough housing 125. The switch container 108 is thus made of, or coated with, an electrically conductive material such as steel or brass. This provides the advantage that the ground path for the ignition assembly 100 bypasses the ignition housing 102, so the ignition assembly 100 can be withdrawn from one well, removed from the tool string, fitted with a new igniter, and installed on a new tool string with minimal or no cleaning required to establish electrical contact with the new tool string. Further, the assembly described herein requires no wire connections. Finally, the assembly can be quickly constructed, as described above, by attaching the igniter 106 to the igniter contact 116, dropping the resulting sub-assembly into the switch container 108, dropping the switch container 108 with the switch assembly into the ignition housing 102, adding the feedthrough contact 118 and plug 230, and attaching the resulting ignition module to a feedthrough module 124, by connecting the feedthrough member 122, or to a tool having a feedthrough member 122. Speed and accuracy of assembling an ignition-enabled downhole tool is improved using the embodiment described herein. The embodiments described herein also require less cleaning at the well site.

The flange 244 extends a short distance radially outward from the first portion 109 of the switch container 108 but does not contact the ignition housing 102. The flange 244 is also shown in FIG. 2 as being angled toward the feedthrough housing 125 to contact the feedthrough module 124 when the contact end 232 of the feedthrough member 122 seats within the feedthrough plug 230. In alternate embodiments, the flange 244 could have a length that provides contact with the ignition housing 102 in addition to the feedthrough housing 125. The flange 244 could have a segmented or curved profile to follow contours of a feedthrough module 124 or of the ignition housing 102. In still other embodiments, the tabbed format could extend to the first portion 109, such that tabs or prongs extend from the second portion 112 upward around the circuit plate 114 to form the flange 244. For example, in one embodiment, three prongs could extend from the top of the second portion 112 around the circuit plate and up to form the flange 244. In such an embodiment, the switch container 108 will be made up of the second portion 112, with three prongs extending up from the second portion 112 to form the flange 244. In another related embodiment, a single prong or thick wire could extend from the second portion 112 around the circuit plate 114 to contact the feedthrough module 124, or other compatible tool. In this embodiment, the switch assembly 104 would not have a switch container, as such, but just a contact member comprising an igniter portion and a contact prong. In such an embodiment, positioning of the circuit plate 114 can be provided using pins that insert into holes in the floor portion 214 of the ignition housing 102, or other convenient means.

Figure 3:
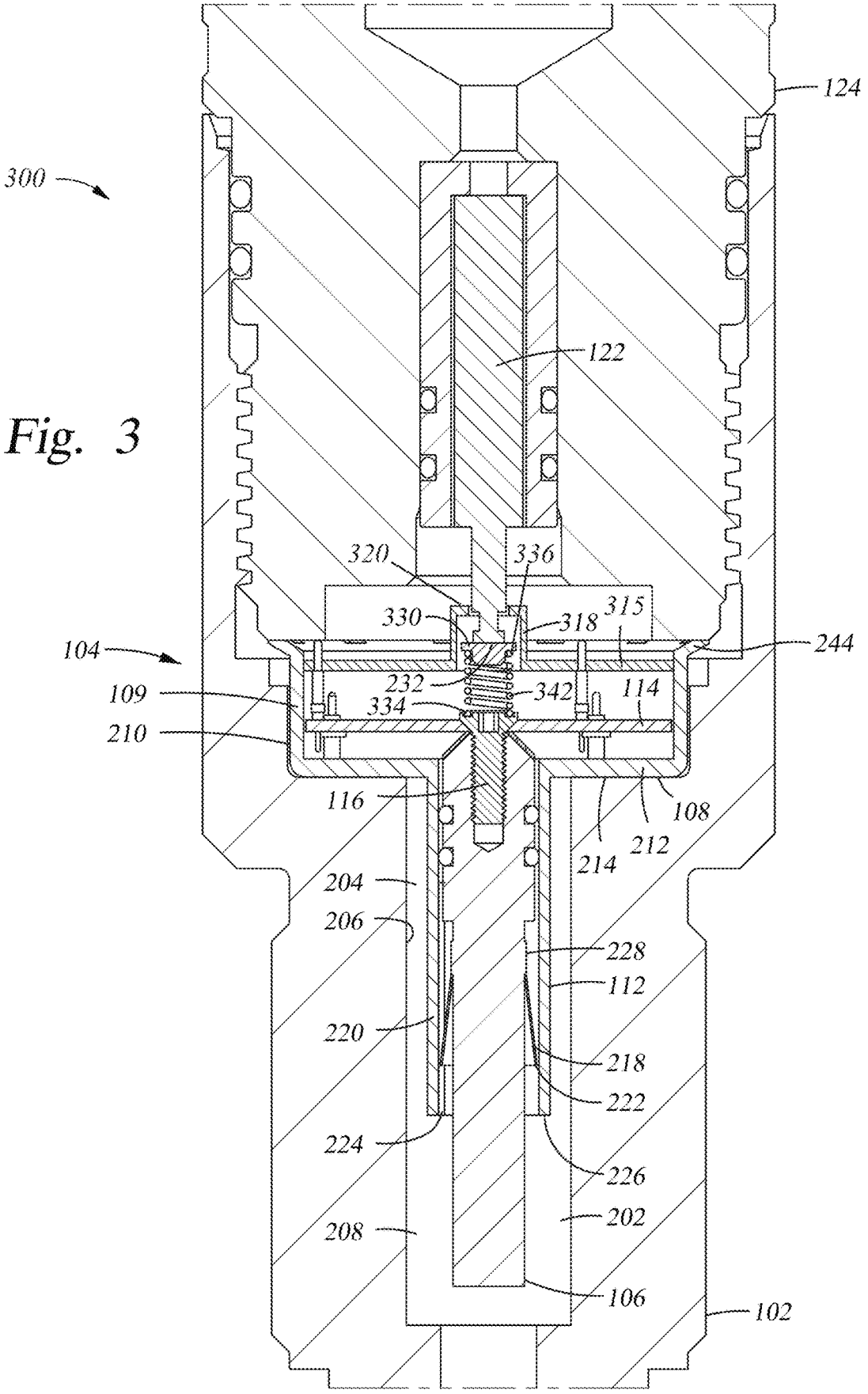
FIG. 3 is a cross-sectional view of a downhole ignition assembly according to another embodiment.

FIG. 3 is a cross-sectional view of a downhole ignition assembly 300 according to another embodiment. The embodiment of FIG. 3 is similar in most respects to the embodiment of FIG. 2. Electrical connection from the feedthrough member 122 is provided differently in the embodiment of FIG. 3. Instead of the feedthrough contact 118 and the feedthrough plug 230, an electrically conductive elastic member 342 is electrically coupled to the circuit plate 114 at a central area thereof and to the igniter contact 116 through the circuit plate 114. The elastic member 342 has a first end 334, which in this case is in direct physical contact with an end of the igniter contact 116 disposed through the circuit plate 114, and a second end 336 opposite from the first end 334. In FIG. 3, an alternate backing plate 315 is used that has a support extension 318 for supporting the elastic member 342 and preventing excessive lateral flexing of the elastic member 342.

A contact cap 330 may be disposed at the second end 336 of the elastic member 342 to provide enhanced electrical contact with the elastic member 342. The contact cap 330 is electrically conductive and has a frustoconical shape, with a flange, to nest within the generally circular second end 336 of the elastic member 342. The flange supports the contact cap 330 at the second end 336 of the elastic member 342. The contact cap 330 makes electrical contact with the feedthrough member 122 when the feedthrough module 124 and the ignition module 101 are assembled. As the feedthrough module 124 is moved into attachment position with the ignition housing 102, the feedthrough member 122 depresses the contact cap 330 and compresses the elastic member 342. The reaction force of the compressed elastic member 342 maintains secure electrical contact of the elastic member 342, contact cap 330, feedthrough member 122 and circuit plate 114.

The elastic member 342 may be a spring of any convenient type. A coil spring or leaf spring member can be used. The leaf spring member has laterally flexing members to provide elasticity as the elastic member 342 changes in length. In alternate embodiments, the elastic member 342 may be electrically coupled to the circuit plate 114, and the igniter contact 116, by a conductive contact disposed in the circuit plate between the elastic member 342 and the igniter contact 116.

The contact cap 330 and second end 336 can be shaped in any beneficial way to enhance contact. The contact cap 330 could have a cylindrical extension portion topped by a flange, for instance. In another example, the contact cap 330 could be longer than that shown in FIG. 3, with an extended cylindrical, conical, or frustoconical length projecting down within the elastic member 342. The contact cap 330 may also be formed integrally with the elastic member 342, which is to say the elastic member 342 may be formed with a contact or cap at the second end 336. In one embodiment, an elastic contact, usable in place of the elastic member 342 and contact cap 330, may have a first contact portion at the first end 334 for making contact with the circuit plate 114 or the igniter contact 116, a second contact portion at the second end 336 for making contact with the feedthrough member 122, and an elastic portion, which may be a spring of any convenient type, between the first contact portion and the second contact portion.

The support extension 318 of the backing plate 315 may have a ledge 320 at a free end thereof that restrains movement of the contact cap 330. When a switch assembly featuring the contact cap 330 and support extension 318 is assembled, the contact cap 330 is positioned in the end of the elastic member 342 and the backing plate 315 is installed with the support extension 318 surrounding the elastic member 342. The ledge 320 contacts the contact cap 330 around an edge thereof, depresses the contact cap 330, and compresses the elastic member 342 such that the contact cap 330 rests against the ledge 320. When the feedthrough module 124 is then assembled to the ignition module 101, with the switch assembly 104 installed, the contact end 232 of the feedthrough member 122 is urged against the contact cap 330 into the support extension 318 of the backing plate 315, depressing the contact cap 330 and compressing the elastic member 342 further, such that a space develops between the contact cap 330 and the ledge 320, as shown in FIG. 3. In this way, as long as the backing plate 315 is in place, the elastic member 342 and contact cap 330 are prevented from exiting the switch assembly 104.

In all the embodiments shown herein, grounding of the igniter 106, and the circuit that energizes the igniter 106, is provided through the second portion 112 of the switch container 108, and through the flange 244 to the feedthrough housing 125. The structures herein simplify field operations by allowing quick reassembly and reuse of the ignition module 101 without the need for substantial cleaning when the assembly is surfaced, since grounding of the ignition circuit does not depend on connectivity with the housing of the ignition assembly.

While the foregoing is directed to embodiments of the present invention, other and further embodiments of the present disclosure may be devised without departing from the basic scope thereof, and the scope thereof is determined by the claims that follow.

What is claimed is:

1. A downhole ignition assembly, comprising:

a switch container having a longitudinal axis, the switch container having a first portion that accommodates a switch circuit in an orientation transverse to the longitudinal axis, and a second portion that electrically contacts an igniter disposed in the second portion, the second portion disposed in an ignition housing, the first portion having a contact that makes electrical contact with a tool coupled to the downhole ignition assembly to provide a ground pathway that bypasses the ignition housing.

2. The downhole ignition assembly of claim 1, wherein the igniter is attached to an electrical contact that provides electrical communication between the igniter and the switch circuit.

3. The downhole ignition assembly of claim 2, wherein the ignition housing contacts the first portion of the switch container.

4. The downhole ignition assembly of claim 2, further comprising a cylindrical feedthrough contact attached to the switch circuit.

5. The downhole ignition assembly of claim 2, further comprising an elastic contact attached to the switch circuit.

6. The downhole ignition assembly of claim 2, further comprising a backing plate disposed in the first portion of the switch container.

7. The downhole ignition assembly of claim 1, further comprising a feedthrough contact electrically connected between the switch circuit and a feedthrough member of the tool.

8. The downhole ignition assembly of claim 7, wherein the tool includes an insulator surrounding the feedthrough member.

9. The downhole ignition assembly of claim 1, wherein the ignition housing has a receptacle and a central passage extending from a floor of the receptacle, and wherein the switch container is disposed in the receptacle.

10. The downhole ignition assembly of claim 9, wherein the first portion of the switch container contacts the floor of the receptacle, and the second portion of the switch container extends along the central passage of the ignition housing.

11. A downhole ignition assembly, comprising:

an ignition module coupled to a feedthrough module, the ignition module comprising:

an ignition housing with an igniter and a switch assembly disposed in the ignition housing, the switch assembly comprising:

a switch container housing a switch circuit, the switch container in electrical contact with the igniter and the feedthrough module, the switch container providing a ground pathway that bypasses the ignition housing, and the switch container having a first portion that houses the switch circuit and a second portion that houses, and electrically contacts, the igniter to provide the ground pathway;

an igniter contact in electrical contact with the switch circuit and the igniter; and a feedthrough contact electrically connected between the switch circuit and a feedthrough member of the feedthrough module, the feedthrough module including an insulator surrounding the feedthrough member.

12. The downhole ignition assembly of claim 11, wherein the switch circuit is a circuit plate positioned transverse to a longitudinal axis of the ignition assembly.

13. The downhole ignition assembly of claim 11, wherein the first portion of the switch container has a flange for making electrical contact with a feedthrough housing of the feedthrough module.

14. The downhole ignition assembly of claim 13, wherein the feedthrough contact is an elastic member.

15. The downhole ignition assembly of claim 13, wherein the ignition housing has a receptacle and a central passage extending from a floor of the receptacle, wherein the switch container is disposed in the receptacle, the first portion of the switch container contacts the floor of the receptacle, and the second portion of the switch container extends along the central passage of the ignition housing.

16. The downhole ignition assembly of claim 15, wherein the feedthrough contact is an elastic member.

17. An ignition module for a downhole ignition assembly, the ignition module comprising:

an ignition housing having a receptacle and a central passage extending from a floor of the receptacle; and a switch assembly disposed in the receptacle and extending along the central passage for energizing an igniter, the switch assembly having a ground path that bypasses the ignition housing, and the switch assembly comprising a switch container with a first portion that accommodates a switch circuit and a second portion that holds, and electrically contacts, the igniter, and the first portion has a flange that provides the ground path bypassing the ignition housing, wherein the first portion is disposed in the receptacle, and the second portion extends along the central passage.

18. The ignition module of claim 17, wherein the switch assembly comprises an igniter contact that electrically connects the igniter to the switch circuit and a feedthrough contact that electrically connects the switch circuit to a power source.

19. The ignition module of claim 18, wherein the feedthrough contact is an elastic member.

20. The ignition module of claim 19, further comprising a backing plate engaged with the first portion of the switch container.

* * * * *